US007337852B2

(12) United States Patent
Manke et al.

(10) Patent No.: US 7,337,852 B2
(45) Date of Patent: Mar. 4, 2008

(54) RUN-IN AND RETRIEVAL DEVICE FOR A DOWNHOLE TOOL

(75) Inventors: Kevin R. Manke, Marlow, OK (US); Iosif J. Hriscu, Duncan, OK (US); Matthew T. Howell, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 238 days.

(21) Appl. No.: 11/133,839

(22) Filed: May 19, 2005

(65) Prior Publication Data

US 2006/0260819 A1 Nov. 23, 2006

(51) Int. Cl.
*E21B 23/00* (2006.01)
*E21B 31/00* (2006.01)

(52) U.S. Cl. ..... 166/381; 166/242.6; 166/301

(58) Field of Classification Search ..... 166/242.6, 166/301, 181, 168, 381, 98, 99
See application file for complete search history.

(56) References Cited

U.S. PATENT DOCUMENTS 3,872,926 A * 3/1975 van Gils ..... 166/301
4,601,343 A * 7/1986 Lindsey et al. ..... 166/382
4,648,445 A 3/1987 Caskey
4,648,446 A 3/1987 Fore et al.
4,651,829 A 3/1987 Hushbeck et al.
5,195,586 A * 3/1993 Gambertoglio ..... 166/240
6,059,042 A * 5/2000 Huber et al. ..... 166/377
6,244,642 B1 6/2001 Serafin et al.
6,467,547 B2 * 10/2002 Maguire et al. ..... 166/386
6,513,589 B1 2/2003 Hansen et al.
2004/0084176 A1 * 5/2004 Hackworth et al. ..... 166/227
2005/0155770 A1 * 7/2005 Parrott ..... 166/380

OTHER PUBLICATIONS

BJ Services Company; Storm Packer Product Information; Oct. 8, 2002; 2 pages.
Foreign communication related to a counterpart application dated Sep. 8, 2006.

* cited by examiner

*Primary Examiner*—Kenneth Thompson
(74) *Attorney, Agent, or Firm*—John W. Wustenberg; Conley Rose, P.C.

(57) ABSTRACT

A run-in and retrieval device for a downhole tool comprises a first set of lugs disposed on a first component of the device connected to a tool string, and a second set of lugs disposed on a second component of the device connected to the downhole tool, wherein the first set of lugs interact with the second set of lugs in a connected position. A method for running at least one downhole tool into a well bore comprises forming a releasable connection between an overshot connected to a tool string and a mandrel connected to the at least one downhole tool, running the at least one downhole tool into the well bore via the tool string, manipulating the at least one downhole tool in the well bore; and, rotating the overshot less than 360 degrees with respect to the mandrel to release the connection therebetween.

28 Claims, 8 Drawing Sheets

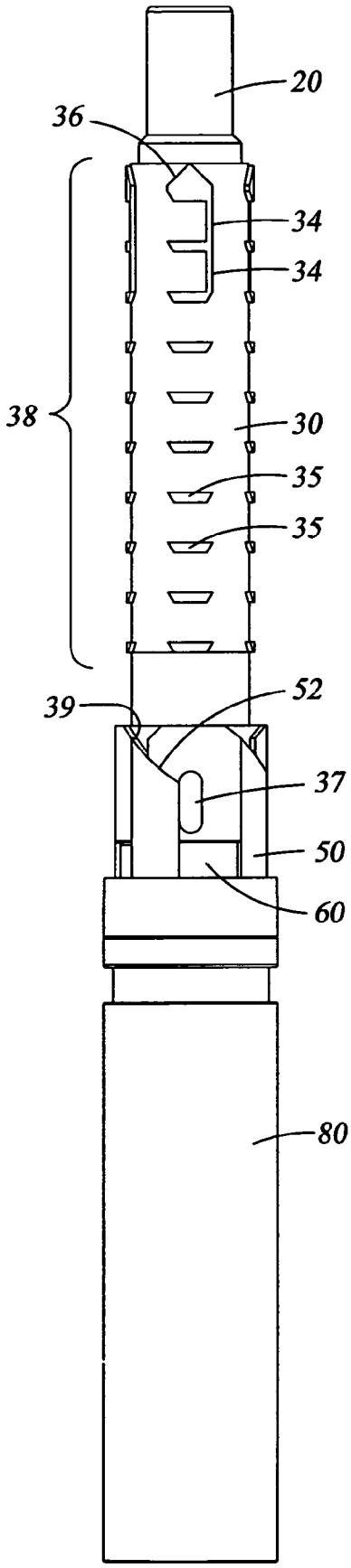
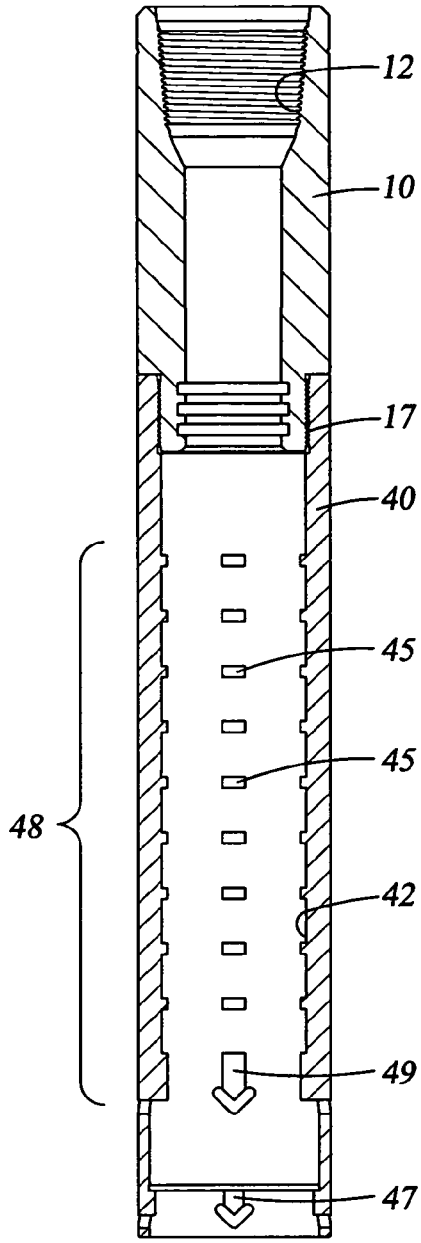
Fig. 3
Fig. 2

RUN-IN AND RETRIEVAL DEVICE FOR A DOWNHOLE TOOL

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates to run-in and retrieval devices for downhole tools, and methods of installing and removing such downhole tools from well bores. More particularly, the present invention relates to run-in and retrieval devices comprising a weight-supporting, releasable connection to a downhole tool through interacting sets of lugs, wherein the connection is formed and released via less than 360-degree degree rotation of one component with respect to another.

BACKGROUND OF THE INVENTION

A wide variety of downhole tools, such as service tools, for example, may be used within a well bore in connection with producing hydrocarbons or reworking a well that extends into a hydrocarbon formation. Downhole tools such as frac plugs, bridge plugs, and packers, for example, may be used to seal a component against casing along the well bore wall or to isolate one pressure zone of the formation from another. Such downhole tools are well known in the art.

Before the production or reworking operation, these downhole tools must be run in and set within the well bore, and after the production or reworking operation is complete, these downhole tools must be removed from the well bore. Tool removal has conventionally been accomplished either by milling or drilling the tool out of the well bore mechanically, or by complex retrieval operations using traditional run-in and retrieval devices.

One type of traditional run-in and retrieval device requires normal right-hand rotation to form a connection between a threaded mandrel and a threaded sleeve, and reverse rotation to disconnect the threaded mandrel from the threaded sleeve. Such reverse rotation is undesirable because it may cause another threaded connection in the tool string to disconnect, or another tool in the tool string to break, before the threaded mandrel and the threaded sleeve disconnect.

Therefore, the next generation of run-in and retrieval device comprises a threaded mandrel that inserts longitudinally into a threaded, ratcheting C-ring to form a releasable connection therebetween. The full weight of the tool string below the device is supported by the interaction between the mandrel and the C-ring ratchet teeth. The C-ring only allows longitudinal movement of the mandrel in one direction so that longitudinal removal of the mandrel is prevented. In this design, a left-hand thread is used so that disconnection of the device is accomplished by normal right-hand rotation, thereby preventing undesired disengagement or breakage of other tool string joints.

Under certain conditions, such as when servicing an offshore extended reach well from a floating platform, there are several disadvantages to using a C-ring type run-in and retrieval device. First, a plurality of full rotations, such as ten (10), for example, must be applied to disengage the mandrel from the C-ring, and a longitudinal force on the mandrel will re-engage the ratchet teeth. Thus, when rotating the mandrel to disengage it while operating from an offshore floating platform that moves up and down in response to wave forces, a longitudinal force may inadvertently be applied to the mandrel, thereby re-engaging the ratchet teeth as the platform heaves. Depending upon wave conditions, this process could be repeated several times before successfully disconnecting the mandrel from the downhole tool. In addition, the C-ring type device is not capable of supporting a significant weight, such as 500 tons, for example, as would be required for a run-in and retrieval device used to support long tool strings for extended reach wells.

Therefore, a need exists for a run-in and retrieval device that easily connects and disconnects from a downhole tool when operating from an offshore floating platform. Further, a need exists for a run-in and retrieval device capable of supporting a significant quantity of weight of the tool string below the device.

SUMMARY OF THE INVENTION

The present disclosure is directed to a run-in and retrieval device for a downhole tool comprising a first set of lugs disposed on a first component of the device connected to a tool string, and a second set of lugs disposed on a second component of the device connected to the downhole tool, wherein the first set of lugs interact with the second set of lugs in a connected position.

In another embodiment, the run-in and retrieval device comprises a mandrel with a first set of lugs, and an overshot with a central opening defining a wall having a second set of lugs disposed therein, the opening being adapted to receive the mandrel, wherein the first set of lugs and the second set of lugs interact to form a releasable connection.

In another aspect, the present disclosure is directed to a method for running at least one downhole tool into a well bore comprising forming a releasable connection between an overshot connected to a tool string and a mandrel connected to the at least one downhole tool, running the at least one downhole tool into the well bore via the tool string, manipulating the at least one downhole tool in the well bore; and, rotating the overshot less than 360 degrees with respect to the mandrel to release the connection therebetween. The method may further comprise removing the overshot from the well bore via the tool string and leaving the mandrel connected to the at least one downhole tool within the well bore.

In another embodiment, the method further includes retrieving the at least one downhole tool from the well bore comprising lowering the overshot into the well bore via the tool string, aligning the overshot with the mandrel for rotation therebetween, rotating the overshot less than 360 degrees with respect to the mandrel to reform the releasable connection therebetween, and retrieving the at least one downhole tool from the well bore via the tool string.

Other aspects and advantages of the invention will be apparent from the following description and the appended claims. The various characteristics described above, as well as other features, will be readily apparent to those skilled in the art upon reading the following detailed description, and by referring to the accompanying drawings.

BRIEF SUMMARY OF THE DRAWINGS

FIG. 2 is a schematic side view of a mandrel component and a slide lock component of the run-in and retrieval device of FIG. 1;

FIG. 3 is a schematic, cross-sectional side view of a top adapter and an overshot component of the run-in and retrieval device of FIG. 1;

NOTATION AND NOMENCLATURE

Figure 1:
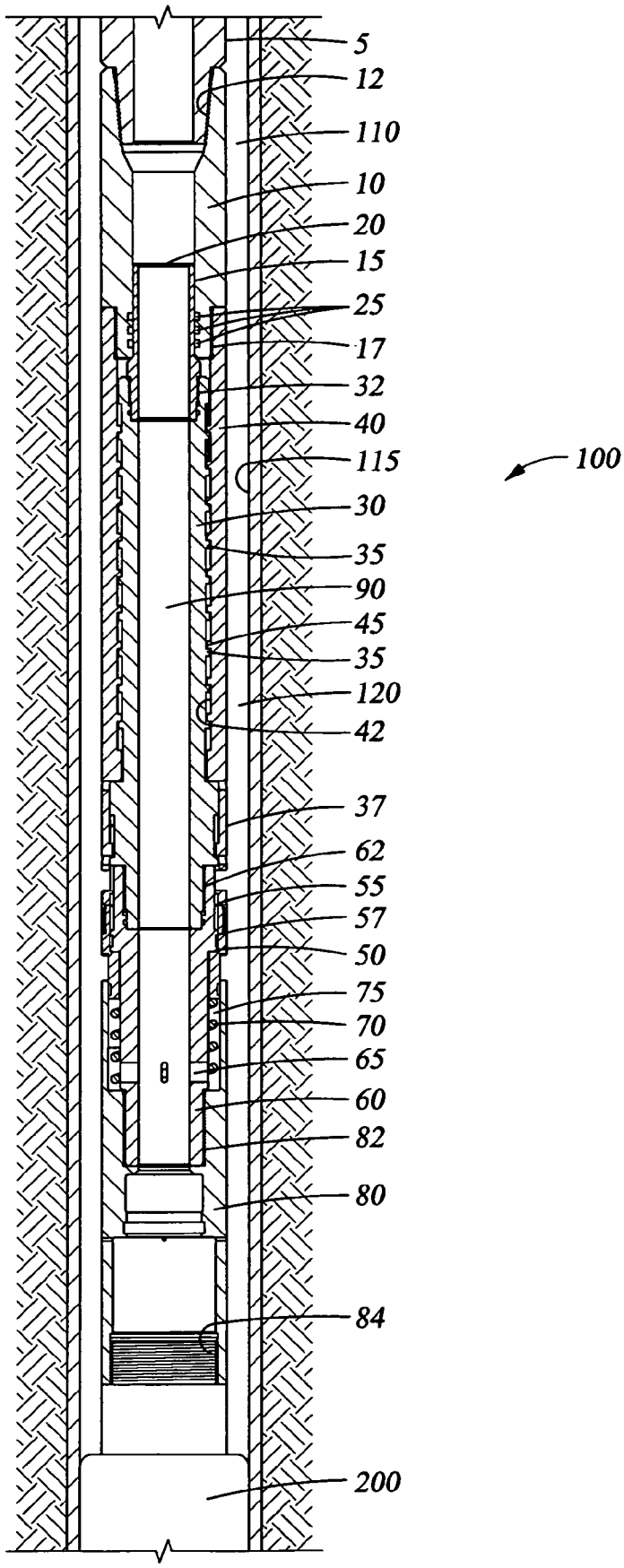
FIG. 1 is a schematic, cross-sectional side view of one embodiment of a run-in and retrieval device in a connected configuration.

Certain terms are used throughout the following description and claims to refer to particular assembly components. This document does not intend to distinguish between components that differ in name but not function. In the following discussion and in the claims, the terms "including" and "comprising" are used in an open-ended fashion, and thus should be interpreted to mean "including, but not limited to . . . ".

Reference to up, down, and longitudinal will be made for purposes of description with "up", "upper", or "upstream" meaning toward the earth's surface or toward the entrance of a well bore; with "down", "lower", or "downstream" meaning toward the bottom of the well bore; and with "longitudinal" meaning along the axis of the well bore.

In the drawings, the side views of the run-in and retrieval device should be viewed from top to bottom, with the upstream end at the top of the drawing and the downstream end at the bottom of the drawing.

DETAILED DESCRIPTION

FIG. 1 depicts a cross-sectional side view of one embodiment of a run-in and retrieval device, generally designated as 100, comprising a top adapter 10, a mandrel extension 20, a mandrel 30, an overshot 40, a slide lock 50, a spring mandrel 60, a spring 70, and a spring housing 80. An internal fluid flow bore 90 extends longitudinally through the device 100.

As shown in FIG. 1, the top adapter 10 comprises an upper box end 12 for connecting to other components, such as the lower end of a tool string 5. Likewise, the spring housing 80 comprises a lower box end 84 for connecting to other components, including one or more downhole tools 200 being run into or retrieved from a well bore 110. As one of ordinary skill in the art will readily appreciate, the device 100 may be used to run-in or retrieve any type of downhole tool 200. In one embodiment, the downhole tool 200 may comprise a control valve, such as the valve depicted and described in U.S. Pat. No. 4,651,829 to Hushbeck et al., hereby incorporated herein for all purposes. In other embodiments, the downhole tool 200 may comprise a packer, a frac plug, or a bridge plug that sets against casing 115 lining the wall of the well bore 110, as shown in FIG. 1. Such a packer, frac plug, or bridge plug may also be installed in the well bore 110 with other types of downhole tools 200, such as the aforementioned control valve. Thus, the run-in and retrieval device 100 could be used with any type of downhole tool 200 that an operator wants to run into a well bore 110, manipulate in the well bore 110, disconnect from, and then later retrieve from the well bore 110.

In the embodiment depicted in FIG. 1, the top adapter 10 connects to the overshot 40 via threads 17. However, the top adapter 10 and the overshot 40 may also be provided as a unitary component. Similarly, in the embodiment of FIG. 1, the mandrel extension 20 connects to the mandrel 30 via threads 32, which in turn connects to the spring mandrel 60 via threads 62, which in turn connects to the spring housing 80 via threads 82. However, in an alternate embodiment, two or more of the mandrel extension 20, mandrel 30, spring mandrel 60, and spring housing 80 may be provided as one or more unitary components.

During assembly, the mandrel extension 20 and the mandrel 30 are longitudinally inserted into the top adapter 10 and the overshot 40. The top adapter 10 slidingly engages the mandrel extension 20 at surface 15, and O-ring seals 25 are disposed therebetween. The mandrel 30 and the overshot 40 are configured to form a releasable connection through the interaction of lugs 35, 45 disposed on each component, respectively. In more detail, the mandrel 30 comprises at least one set of longitudinally spaced lugs 35 disposed externally on a wall thereof, and the overshot 40 comprises a central opening 42 wherein at least one set of longitudinally spaced lugs 45 are formed on an internal wall thereof. The internal and external lugs 45, 35 may either be aligned to interact longitudinally to form a releasable connection as shown in FIG. 1, or through a rotation of less than 360 degrees, the internal and external lugs 35, 45 may be misaligned longitudinally to release the connection between the overshot 40 and the mandrel 30, as will be described in more detail herein.

Below the mandrel 30, a slide lock 50 is slidably disposed about the spring mandrel 60 at surface 55 and forms a sealing connection 57 therewith. The slide lock 50 is biased upwardly to a locked position by a spring 70 disposed within a spring chamber 75 that is formed between the spring mandrel 60 and the spring housing 80. Ports 65 extend through a wall of the spring mandrel 60 to allow fluid communication between the longitudinal flow bore 90 and the spring chamber 75. The slide lock 50 is configured to be repositioned in response to hydraulic pressure or a mechanical force applied to the slide lock 50 by the overshot 40, as will be described in more detail herein. In another embodiment, the slide lock 50 may be configured to be repositioned electromechanically.

Referring now to FIG. 2, the mandrel extension 20, the mandrel 30, the slide lock 50, the spring mandrel 60, and the spring housing 80 are shown connected together and with the top adapter 10 and overshot 40 removed. The mandrel 30 may include one or more sets 38 of external lugs 35 spaced circumferentially about the mandrel 30. In one embodiment, the mandrel 30 comprises four (4) sets 38 of external lugs 35, spaced at 90-degree intervals circumferentially about the mandrel 30, and each set 38 comprises ten (10) longitudinally spaced external lugs 35.

FIG. 3 depicts a cross-sectional size view of the top adapter 10 and the overshot 40 disconnected from the remaining components of the device 100. The overshot 40 includes one or more sets 48 of internal lugs 45 spaced apart circumferentially about the overshot 40. In an embodiment, the number and location of the internal lugs 45 on the overshot 40 corresponds directly to the number and location of the external lugs 35 on the mandrel 30 as shown in FIG. 2 and FIG. 3. However, in other embodiments, a different number of internal lugs 45 and external lugs 35 may be provided, so long as the lugs 45, 35 interact to form a releasable connection.

Further, the internal lugs 45 and the external lugs 35 are adapted to engage as shown in FIG. 1 to support weight below the releasable connection. The size and number of engaging lugs 45, 35, and more specifically, the total cross-sectional area of engagement of the lugs 45, 35, determines the quantity of weight that can be supported by the device 100. In one embodiment, four (4) sets 48, 38 of ten (10) lugs 45, 35 are provided on the overshot 40 and the mandrel 30 respectively; the sets 48, 38 are spaced apart at 90-degree intervals circumferentially; the lugs 45, 35 are each approximately ½-inch wide and ¼-inch high; and the device 100 is adapted to support 500 tons of weight. Assuming the same size of engaging lugs 45, 35, the amount of weight that can be supported by the device 100 changes linearly with the quantity of lugs 45, 35 provided. For example, if the embodiment described above included only half as many lugs 45, 35, the device 100 would be adapted to support 250 tons of weight, and if the embodiment described above included twice as many lugs 45, 35, the device 100 would be adapted to support 1,000 tons of weight. Similarly, assuming the same quantity of engaging lugs 45, 35, the amount of weight that can be supported by the device 100 changes linearly with the size of the lugs 45, 35 provided. For example, if the embodiment described above included the same quantity of lugs 45, 35 but the lugs 45, 35 were only half the size, the device 100 would be adapted to support 250 tons of weight, and if the embodiment described above included the same quantity of lugs 45, 35 but the lugs 45, 35 were twice the size, the device 100 would be adapted to support 1,000 tons of weight.

As best depicted in FIG. 2 and FIG. 3, to aid with alignment of the overshot 40 as it is being lowered over the mandrel 30 for retrieval of the downhole tool 200 from the well bore 110, at least one set 38 of external lugs 35 comprises a tapered upper surface 36 on the uppermost external lug 35. This tapered upper surface 36 corresponds to the shape of at least one angled alignment key 49 on the overshot 40. Thus, the interaction between the tapered upper surface 36 on the uppermost external lug 35 and the angled alignment key 49 guides the overshot 40 into proper alignment so that the overshot 40 can further be lowered over the mandrel 30.

Referring again to FIG. 2, in an embodiment, the mandrel 30 further comprises one or more J-slots 37 configured to receive at least one angled guide key 47 on the overshot 40 as the overshot 40 is being lowered over the mandrel 30. The J-slot 37 is shown partially covered by the slide lock 50 in FIG. 2, and can best be seen in FIG. 6. The interaction between the J-slots 37 and the angled guide keys 47 imparts a rotation of less than 360 degrees in a first direction to the overshot 40 as it is being lowered longitudinally over the stationary mandrel 30. In the embodiments shown herein, the interaction between the J-slots 37 and the angled guide keys 47 imparts a maximum of a 90-degree rotation to the overshot 40. Such rotation causes the internal lugs 45 and the external lugs 35 to interact to form a releasable connection as shown in FIG. 1. Thus, the J-slots 37 act as rotational guide slots. In addition, the J-slots 37 may comprise V-shaped entrances 39 corresponding to the shape of the angled guide keys 47, thereby facilitating entry of the guide keys 47 into the J-slots 37. In another embodiment of the device 100, the mandrel 30 does not include J-slots 37. In this embodiment, the overshot 40 is lowered to a known position with respect to the mandrel 30, such as by engaging a shoulder, and then the overshot 40 is rotated less then 360 degrees in a first direction with respect to the mandrel 30.

Referring again to FIG. 1 and FIG. 2, to disengage the internal lugs 45 from the external lugs 35, a 45-degree rotation opposite of the first direction is applied to the tool string 5 from the surface of the well bore 110, thereby rotating the overshot 40 with respect to the mandrel 30. To ensure that the overshot 40 is not over-rotated with respect to the mandrel 30 during release, the mandrel 30 may comprise a rotational stop 34 that extends between at least two of the external lugs 35 to act as a barrier for preventing the internal lugs 45 from reconnecting and reengaging with the external lugs 35.

Figure 9:
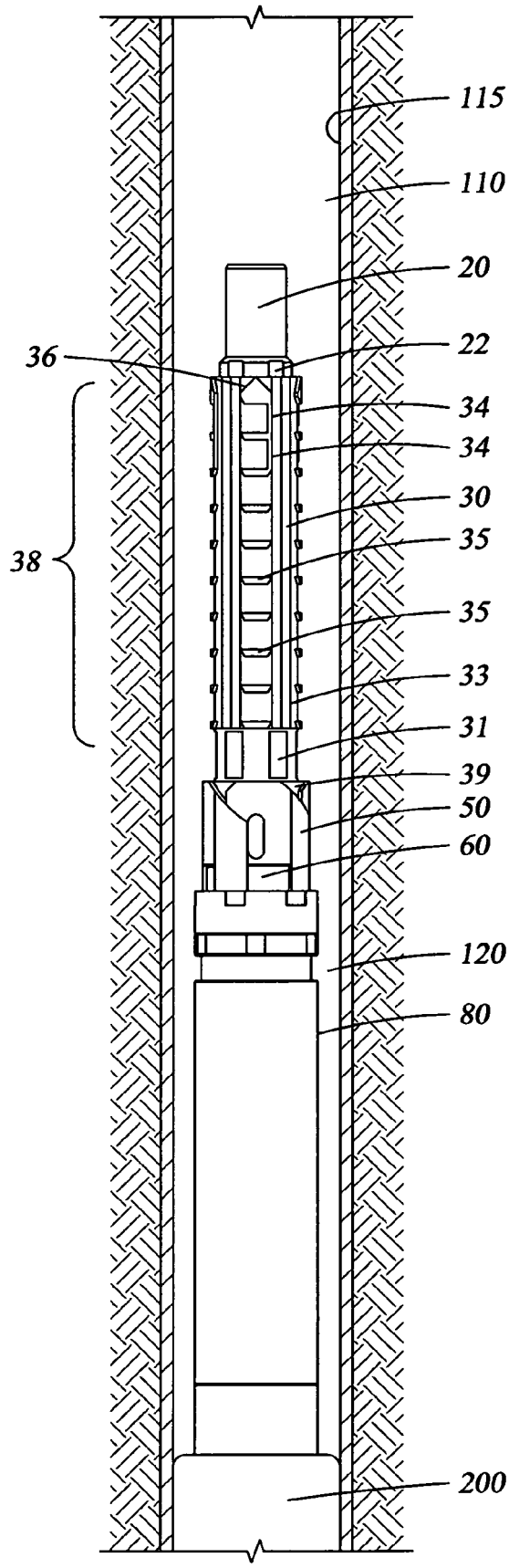
FIG. 9 is a schematic side view of the mandrel and slide lock of the run-in and retrieval device of FIG. 1 connected to a downhole tool within a well bore.

FIG. 9 depicts several additional features of the device 100. For example, the mandrel extension 20 may optionally be provided with wrench flats 22, and the mandrel 30 may optionally be provided with wrench flats 31 for assembly purposes. Further, the mandrel extension 20, mandrel 30, spring mandrel 60 and spring housing 80 are shown as separate components, but could instead be provided as one or more unitary components, as previously mentioned. In addition, the mandrel 30 may be constructed using a mill such that mill passes 33 would be evident on the mandrel 30, or the mandrel 30 could be formed as a solid cylindrical component as shown in FIG. 2.

Operation of the Run-In and Retrieval Device

Figure 4:
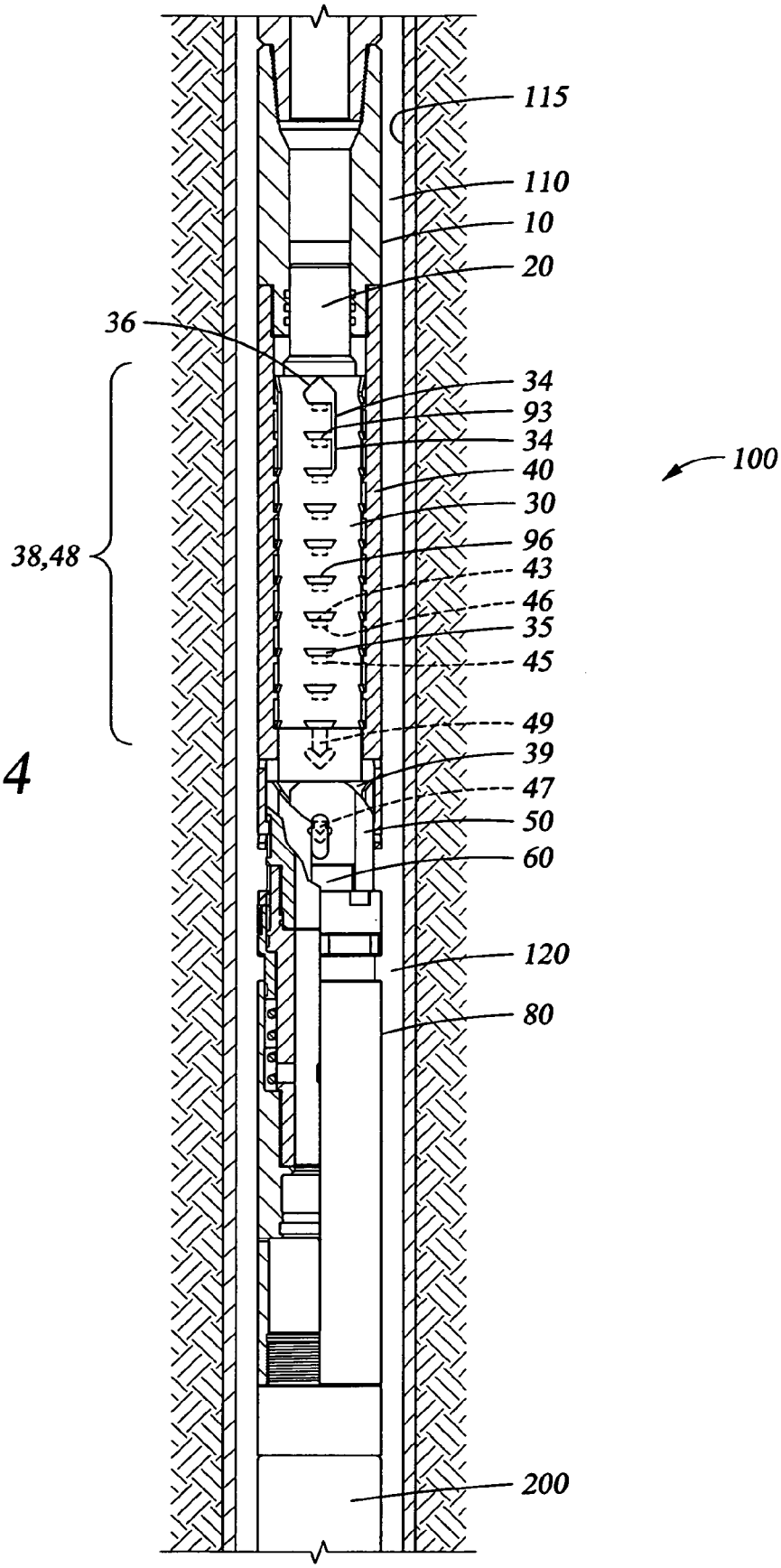
FIG. 4 is a schematic side view, partially in cross-section, of the run-in and retrieval device of FIG. 1, depicting the overshot and the mandrel in a connected and locked configuration, positioned to support weight below the device.

FIGS. 4-9 depict two operating sequences for the run-in and retrieval device 100, namely a run-in operating sequence and a retrieval operating sequence. Specifically, FIG. 4 depicts the device 100 in a connected and locked configuration for running a downhole tool 200 into the well bore 110, and FIGS. 5-9 depict the operating sequence to manipulate the downhole tool 200, then unlock the device 100 and remove the top adapter 10 and overshot 40 from the well bore 110. However, in reverse order, FIGS. 4-9 also depict the overshot 40 being reconnected with the mandrel 30 to retrieve the downhole tool 200 from the well bore 110.

Referring first to the run-in operating sequence, FIG. 4 depicts the device 100 in a connected, locked, and weight-supporting configuration. In particular, the internal lugs 45 on the overshot 40 and the external lugs 35 on the mandrel 30 are shown interacting to form a releasable connection, and the upper surfaces 43 of the internal lugs 45 are shouldered against the lower surfaces 93 of the external lugs 35, thereby reflecting that the device 100 is supporting weight. Further, a guide key 47 on the overshot 40 is shown disposed within a J-slot 37 on the mandrel 30, and the slide lock 50 is in its uppermost, locked position, covering a portion of the J-slot 37. As depicted in FIG. 1, the slide lock 50 is biased to the locked position of FIG. 4 by a spring 70 disposed in the spring cavity 75 within the spring housing 80. In this locked position, the slide lock 50 prevents disconnection of the overshot 40 from the mandrel 30 during run-in.

Figure 5:
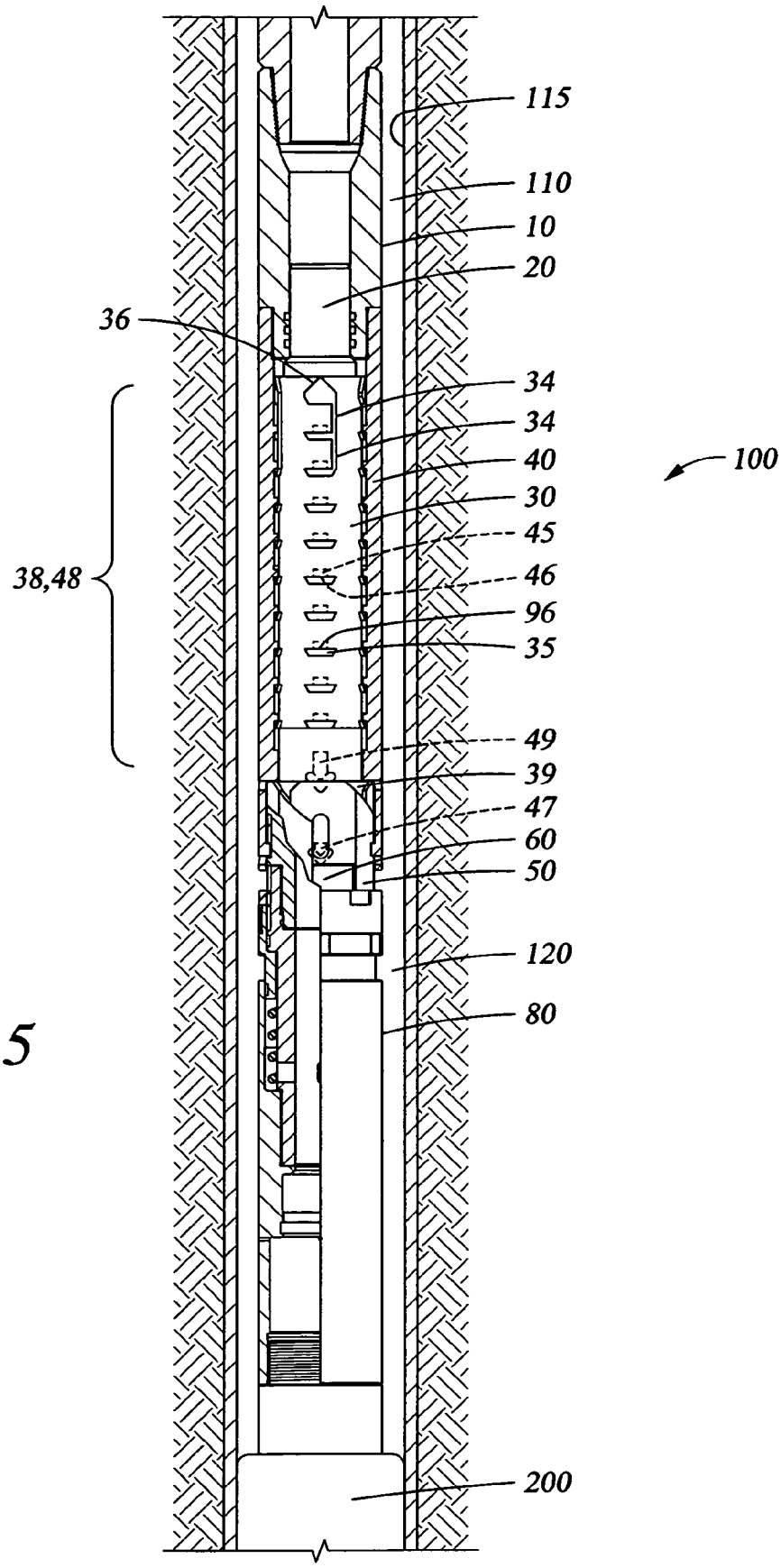
FIG. 5 is a schematic side view, partially in cross-section, of the run-in and retrieval device of FIG. 1, depicting the overshot and the mandrel in a connected and locked configuration, positioned to transfer force to a downhole tool below the device.

Once the downhole tool 200 is lowered to the desired depth, force may be applied from the surface through the tool string 5 to manipulate the downhole tool 200. FIG. 5 depicts the run-in and retrieval device 100 positioned to transfer force from the tool string 5 to a downhole tool 200, such as when setting a packer against casing 115 in the well bore 110, for example. As force is applied through the tool string 5, the overshot 40 is forced downwardly with respect to the mandrel 30 until the lower surfaces 46 of the internal lugs 45 are shouldered against the upper surfaces 96 of the external lugs 35, thereby transferring force to the downhole tool 200. As shown in FIG. 5, the guide key 47 on the overshot 40 has moved downwardly within the J-slot 37 on the mandrel 30, but the slide lock 50 is still biased by the spring 70 to its uppermost, locked position.

Figure 6:
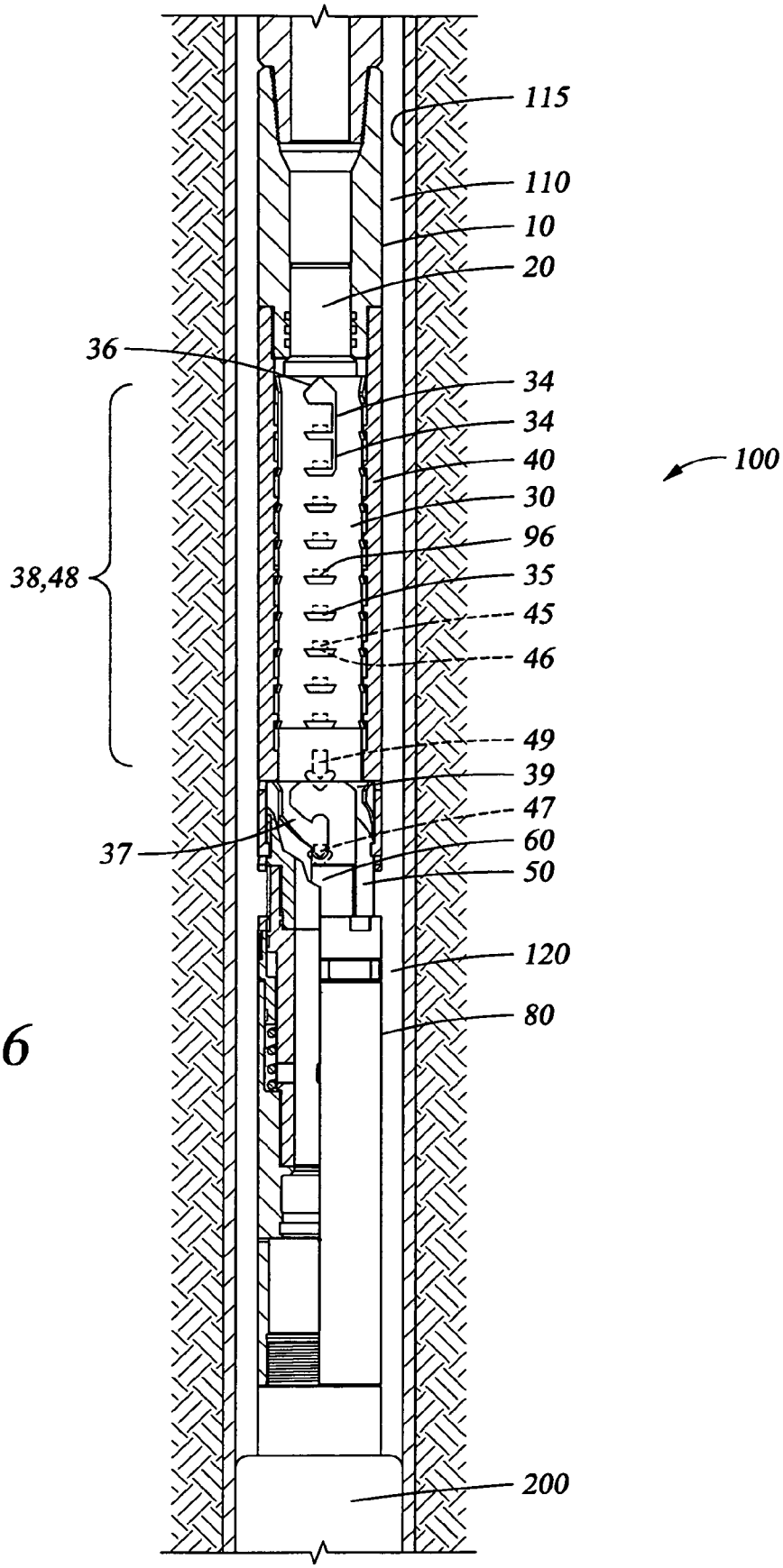
FIG. 6 is a schematic side view, partially in cross-section, of the run-in and retrieval device of FIG. 1, depicting the overshot and the mandrel in a connected and unlocked configuration, positioned to disconnect from a downhole tool below the device.

FIGS. 6-9 depict the sequence for unlocking the device 100 and rotating the overshot 40 by less than 360 degrees opposite of the first direction with respect to the mandrel 30 to allow removal of the top adapter 10 and overshot 40 from the well bore 110. Referring first to FIG. 6, after the one or more downhole tools 200 have been manipulated and set in the well bore 110, the slide lock 50 may be forced downwardly to unlock the device 100 by applying a differential pressure across the slide lock 50 against biasing spring 70. In particular, referring again to FIG. 1, because a sealing connection 25 is provided between the top adapter 10 and the mandrel extension 20, and there is no fluid flowing through the flow bore 90 in the device 100, a differential pressure can be applied across the slide lock 50 against the spring 70 by pressuring up the well bore annulus 120 formed between the device 100 and the casing 115. When no pressure is applied to the well bore annulus 120, the spring 70 expands to bias the slide lock 50 upwardly to the locked position. However, because the spring chamber 75 is in fluid communication with the device flow bore 90 via ports 65 in the spring mandrel 60, once pressure is applied to the well bore annulus 120, a differential pressure is created across the slide lock 50, thereby allowing the slide lock 50 to overcome the bias of the spring 70 and move downwardly to the unlocked position shown in FIG. 6 wherein the J-slot 37 is fully visible. Thus, in one embodiment, the slide lock 50 is biased to respond to pressure in the well bore annulus 120.

In another embodiment, the slide lock 50 may be biased to respond to differential pressure created by applying pressure to the flow bore 90 rather than applying pressure to the well bore annulus 120. Again, because the spring chamber 75 is in fluid communication with the flow bore 90 via ports 65 in the spring mandrel 60, by pressuring up the fluid within the flow bore 90, a differential pressure is created across the slide lock 50, thereby allowing the slide lock 50 to overcome the bias of the spring 70 and move downwardly to the unlocked position shown in FIG. 6. Thus, in the alternative embodiment, the slide lock 40 is biased to respond to tubing pressure.

Figure 7:
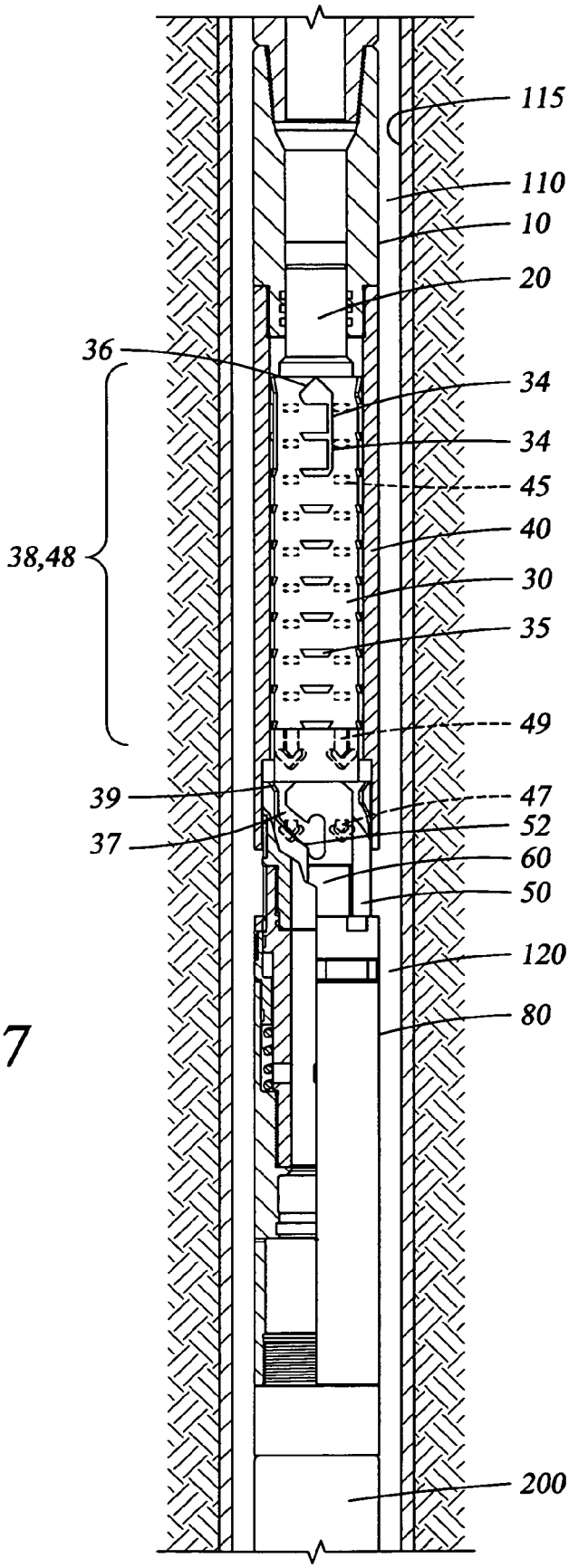
FIG. 7 is a schematic side view, partially in cross-section, of the run-in and retrieval device of FIG. 1, depicting the overshot and the mandrel in a released and unlocked configuration.

Once the device 100 is unlocked, and with the lower surface 46 of the internal lugs 45 shouldered against the upper surface 96 of the external lugs 35, an opposite rotation may be applied to the tool string 5, thereby causing the top adapter 10 and overshot 40 to rotate opposite of the first direction with respect to the mandrel 30. The rotation will be less than 360 degrees, and in the embodiments depicted herein where four (4) interacting sets of lugs 38, 48 are positioned 90 degrees apart circumferentially, the rotation will be 45 degrees. As shown in FIG. 7, as this 45-degree opposite rotation is applied, the internal lugs 45 disengage from and move out of alignment with the external lugs 35 to a released position. Further, as the opposite rotation is applied, the rotational stop 34 will provide a barrier to prevent reconnection of the internal lugs 45 with the external lugs 35.

Thus, in various embodiments, the run-in and retrieval device 100 includes several safety features. First, to prevent inadvertent release of the device 100, three different operations are required to disconnect the overshot 40 from the mandrel 30 in the run-in sequence. Specifically, the operator must slack off weight, i.e. exert a downward force on the overshot 40 through the tool string 5 to move the overshot 40 from the position shown in FIG. 4, wherein the device 100 is supporting weight, to the position shown in FIG. 5, wherein the lower surface 46 of the internal lugs 45 are shouldered against the upper surface 96 of the external lugs 35. Then an adequate differential pressure must be applied across the slide lock 50 against the spring 70 so that the slide lock 50 moves downwardly to the unlocked position shown in FIG. 6. Finally, a torque must be applied through the tool string 5 to rotate the top adapter 10 and overshot 40 by 45 degrees opposite of the first direction with respect to the mandrel 30 to disengage the internal lugs 45 from the external lugs 35 as shown in FIG. 7. Therefore, exerting downward force on the overshot 40 and pressuring up on the well bore annulus 120 are both required to unlock the device 100, and a torque is required to impart a 45-degree rotation to release the overshot 40 from the mandrel 30.

Another safety feature is the rotational stop 34 extending between at least two of the external lugs 35. As previously described, a torque will be applied to the overshot 40 via the tool string 5 to cause the 45-degree opposite rotation required to disconnect the overshot 40 from the mandrel 30. The rotational stop 34 acts as a barrier to prevent over-rotation so that the internal lugs 45 do not inadvertently reengage the external lugs 35 when trying to disconnect.

Figure 8:
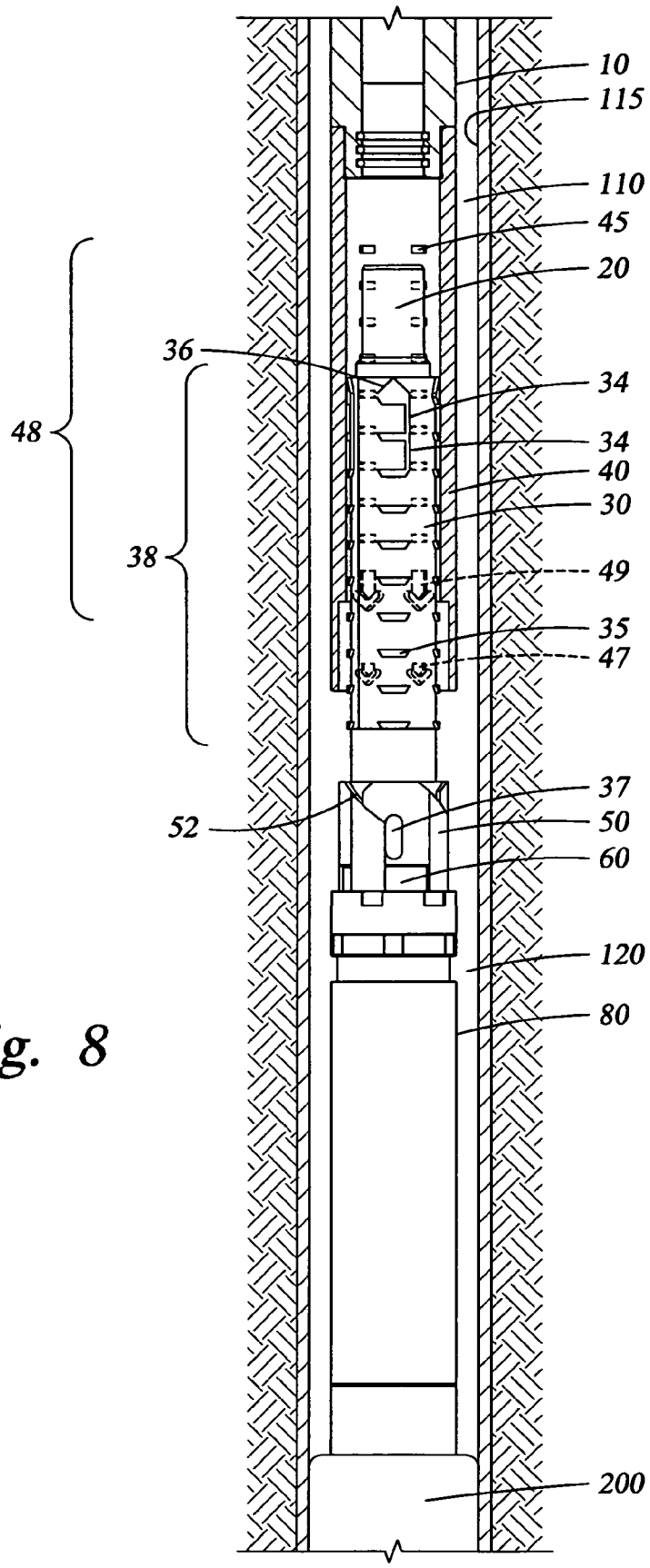
FIG. 8 is a schematic side view, partially in cross-section, of the run-in and retrieval device of FIG. 1, depicting the overshot and the mandrel in a released configuration, with the overshot either being removed from the mandrel or being lowered over the mandrel.

Once the overshot 40 is released from the mandrel 30, the top adapter 10 and the overshot 40 are removable from the remaining components of the device 100 as shown in FIG. 8. After the top adapter 10 and overshot 40 are removed, the mandrel extension 20, the mandrel 30, the slide lock 50, the spring mandrel 60, the spring 70, and the spring housing 80 are still connected to the downhole tool 200 within the well bore 110 as shown in FIG. 9.

FIGS. 4-9, when viewed in reverse order, also depict a retrieval operating sequence for the device 100, wherein the top adapter 10 and the overshot 40 are run back into the well bore 110 to reconnect with the mandrel 30 to withdraw the downhole tool 200 from the well bore 110. Referring first to FIG. 9, the mandrel extension 20, the mandrel 30, the slide lock 50, the spring mandrel 60, the spring 70, and the spring housing 80 are shown connected to the downhole tool 200 within the well bore 110. The slide lock 50 moved upwardly over the J-slot 37 in response to the spring 70 force since pressure was removed from the well bore annulus 120.

Referring now to FIG. 8, as the top adapter 10 and overshot 40 are lowered over the mandrel extension 20 and mandrel 30, the angled alignment key 49 on the overshot 40 will engage the upper tapered surface 36 of the external lugs 35 on the mandrel 30. This engagement will cause the overshot 40 to rotate into proper alignment with the mandrel 30 so that the sets 48 of internal lugs 45 will fit between the sets 38 of external lugs 35 as the overshot 40 continues moving downwardly. Therefore, regardless of the position of the overshot 40 as it is being run into the well bore 110, the upper tapered surface 36 on the external lugs 35 will interact with the angles on the alignment key 49 to properly align the overshot 40 with respect to the mandrel 30.

Further, in an embodiment, the alignment key 49 has a longitudinal length that exceeds the distance between two of the lugs 35 on the mandrel 30. Therefore, because the angled alignment key 49 will not fit between two lugs 35 on the mandrel 30, the overshot 40 and mandrel 30 can not form a partial connection. Instead, the overshot 40 must be lowered completely over the mandrel 30 so that when the overshot 40 is rotated to form the releasable connection, the sets 48 of lugs 45 on the overshot 40 and the sets 38 of lugs 35 on the mandrel 30 are fully engaged, and the angled alignment key 49 is positioned below the lowermost mandrel lug 35.

Referring now to FIG. 7, as the overshot 40 continues to be lowered with respect to the mandrel 30, the angled guide key 47 will extend into the J-slot 37 via the V-shaped opening 39 while mechanically engaging a tapered upper surface 52 on the slide lock 50, thereby forcing the slide lock 50 downwardly to an unlocked position against the force of the spring 70. Thus, when reconnecting the overshot 40 to the mandrel 30, no pressure is required to be applied to the well bore annulus 120 or to the flow bore 90 to cause the slide lock 50 to move downwardly against the spring 70 in response to differential pressure. Instead, only the mechanical force of the angled guide key 47 acting on the tapered upper surface 52 of the slide lock 50 is required. In an alternative embodiment, the slide lock 50 may be actuated electromechanically, such as by using a downhole motor to retract the slide lock 50 in response to a tripped switch, for example.

As the overshot 40 continues moving downwardly in a longitudinal direction, the guide key 47 traverses the J-slot 37, and the angled shape of the J-slot 37 will thereby impart a maximum 90-degree rotation in the first direction to the overshot 40. As shown in FIG. 6, as the guide key 47 moves toward the lowermost point in the J-slot 37, the internal lugs 45 of the overshot 40 are rotated to interact with and engage the external lugs 35 on the mandrel 30. Once the guide key 47 is no longer engaging the slide lock 50 to mechanically force it down, the slide lock 50 will return to the uppermost, locked position shown in FIG. 5, in response to the bias force of the spring 70.

The device 100 is now reconnected and locked so that the one or more downhole tools 200 can be retrieved from the well bore 110. When the device is in the configuration shown in FIG. 5, the downhole tool 200 can be released from the casing 115, thereby transferring weight to the interacting and engaging lugs 45, 35. This will allow the overshot 40 to be raised up with respect to the mandrel 30 so that the upper surface 43 of the internal lugs 45 shoulder against the lower surface 93 of the external lugs 35 as shown in FIG. 4. Still referring to FIG. 4, when the device 100 is in a weight-supporting position, in one embodiment, the guide key 47 is positioned within a vertical portion of the J-slot 37 so that the guide key 47 does not support any weight. Thus, the guide key 47 is not required to have the same strength as the lugs 35, 45. As shown in FIG. 4, the connected, locked, and weight-supporting device 100 is configured to retrieve the downhole tool 200 from the well bore 110.

Thus, the run-in and retrieval device 100 comprises a releasable, weight-supporting connection via interacting and engaging lugs 35, 45 that can be designed to support large quantities of weight, such as 500 tons, for example. Further, the device 100 facilitates easy release from a downhole tool 200, such as when operating from a floating offshore rig, because the lugs 35, 45 are disconnected via a 45-degree opposite rotation of the overshot 40 with respect to the mandrel 30. When reconnecting the lugs 35, 45, a 45-degree rotation in the first direction may be imparted automatically via a guide key 47 interacting with a J-slot 37. The device 100 may further comprise several safety features, such as a slide lock 50 that requires multiple actions to open in the run-in position, thereby preventing inadvertent disconnection, an alignment key 49 having a length that prevents a partial connection between the lugs 45 of the overshot 40 and the lugs 35 of the mandrel 30, and a rotational stop 34 that prevents inadvertent re-connection during release of the overshot 40 from the mandrel 30.

The foregoing descriptions of specific embodiments of the run-in and retrieval device 100, and the systems and methods for running in and removing one or more downhole tools 200 from the well bore 110, have been presented for purposes of illustration and description and are not intended to be exhaustive or to limit the invention to the precise forms disclosed. Obviously many other modifications and variations are possible. In particular, the specific type and quantity of components that make up the device 100 could be varied. For example, a larger or smaller number of interacting and engaging lugs 35, 45 having the same cross-sectional area of engagement could be used to support the same amount of weight. Further, the upper tapered lug surface 36, the angled guide key 47, the angled alignment key 49, the V-shaped openings 39, the J-slots 37, and the slide lock 50 are all optional features of the device 100.

While various embodiments of the run-in and retrieval device 100 have been shown and described herein, modifications may be made by one skilled in the art without departing from the spirit and the teachings of the invention. The embodiments described are exemplary only, and are not intended to be limiting. Many variations, combinations, and modifications of the device and methods disclosed herein are possible and are within the scope of the invention. Accordingly, the scope of protection is not limited by the description set out above, but is defined by the claims which follow, that scope including all equivalents of the subject matter of the claims.

What we claim as our invention is:

1. A run-in and retrieval device for a downhole tool comprising:

a first set of lugs disposed on a first component of the device connected to a tool string;

a second set of lugs disposed on a second component of the device connected to the downhole tool, wherein the first set of lugs interact with the second set of lugs in a connected position; and a slidable locking mechanism, wherein the slidable locking mechanism secures the lugs' interaction in the connected position, and wherein the locking mechanism is releasable hydraulically, mechanically, electromechanically, or a combination thereof.

2. The device of claim 1 wherein the second component is adapted to remain connected to the downhole tool in a well bore.

3. The device of claim 1 wherein the first set of lugs engages the second set of lugs to support weight in the connected position.

4. The device of claim 3 wherein a total cross-sectional area of engagement between the first set of lugs and the second set of lugs defines the maximum quantity of weight that can be supported.

5. The device of claim 1 wherein a relative rotation between the first component and the second component moves the device between the connected position and a released position wherein the first component is removable from the second component.

6. The device of claim 5 wherein the relative rotation comprises less than a 360-degree rotation.

7. A run-in and retrieval device for a downhole tool comprising:

a first set of lugs disposed on a first component of the device connected to a tool string;

a second set of lugs disposed on a second component of the device connected to the downhole tool, wherein the first set of lugs interact with the second set of lugs in a connected position;

a slidable locking mechanism, wherein the slidable locking mechanism secures the lugs' interaction in the connected position, and wherein a relative rotation between the first component and the second component moves the device between the connected position and a released position wherein the first component is removable from the second component, and further comprising a guide key on the first component adapted to interact with a guide slot on the second component to cause the relative rotation as the first component is lowered with respect to the second component in the released position.

8. A run-in and retrieval device for a downhole tool comprising:

a first set of lugs disposed on a first component of the device connected to a tool string;

a second set of lugs disposed on a second component of the device connected to the downhole tool, wherein the first set of lugs interact with the second set of lugs in a connected position;

wherein a relative rotation between the first component and the second component moves the device between the connected position and a released position, and wherein the first component is removable from the second component; and further comprising an alignment key on the first component adapted to interact with at least one lug of the second set of lugs to align the first component and the second component for relative rotation therebetween as the first component is lowered with respect to the second component in the released position.

9. The device of claim 8 wherein the alignment key is configured to ensure full interaction of the first set of legs and the second set of lugs in the connected position.

10. A run-in and retrieval device for a downhole tool comprising:

a first set of lugs disposed on a first component of the device connected to a tool string;

a second set of lugs disposed on a second component of the device connected to the downhole tool, wherein the first set of lugs interact with the second set of lugs in a connected position;

a slidable locking mechanism, wherein the slidable locking mechanism secures the lugs' interaction in the connected position, and wherein a relative rotation between the first component and the second component moves the device between the connected position and a released position wherein the first component is removable from the second component, and further comprising a rotational stop to prevent over-rotation when moving the device between the connected position and the released position.

11. A run-in and retrieval device for a downhole tool comprising:

a first set of lugs disposed on a first component of the device connected to a tool string;

a second set of lugs disposed on a second component of the device connected to the downhole tool, wherein the first set of lugs interact with the second set of lugs in a connected position;

a slidable locking mechanism, wherein the slidable locking mechanism secures the lugs' interaction in the connected position, and wherein the locking mechanism is biased to a locked position by a spring.

12. A run-in and retrieval device for a downhole tool comprising:

a first set of lugs disposed on a first component of the device connected to a tool string;

a second set of lugs disposed on a second component of the device connected to the downhole tool, wherein the first set of lugs interact with the second set of lugs in a connected position;

a slidable locking mechanism, wherein the slidable locking mechanism secures the lugs' interaction in the connected position, and wherein the locking mechanism is adapted to facilitate rotation between the first component and the second component.

13. A method for running at least one downhole tool into a well bore comprising:

forming a releasable connection between an overshot connected to a tool string and a mandrel connected to the at least one downhole tool;

running the at least one downhole tool into the well bore via the tool string;

manipulating the at least one downhole tool in the well bore;

releasing a slidable locking mechanism to allow rotation between the overshot and the mandrel; and rotating the overshot less than 360 degrees with respect to the mandrel to release the connection therebetween.

14. The method of claim 13 wherein forming the releasable connection comprises causing lugs on the overshot to interact with lugs on the mandrel.

15. The method of claim 14 further comprising engaging the overshot lugs with the mandrel lugs to support weight below the releasable connection.

16. The method of claim 14 further comprising ensuring full interaction between the lugs on the overshot and the lugs on the mandrel.

17. The method of claim 13 wherein releasing the locking mechanism comprises applying pressure to the well bore or to the tool string.

18. The method of claim 17 wherein releasing the locking mechanism further comprises applying a force to the tool string.

19. The method of claim 13 further comprising removing the overshot from the well bore via the tool string and leaving the mandrel connected to the at least one downhole tool within the well bore.

20. The method of claim 19 further comprising retrieving the at least one downhole tool from the well bore comprising:

lowering the overshot into the well bore via the tool string;

aligning the overshot with the mandrel for rotation there between;

releasing a slidable locking mechanism;

rotating the overshot less than 360 degrees with respect to the mandrel to reform the releasable connection therebetween; and retrieving the at least one downhole tool from the well bore via the tool string.

21. The method of claim 20 wherein the overshot is caused to rotate with respect to the mandrel by moving the overshot longitudinally downwardly over the mandrel.

22. The method of claim 20 wherein the overshot is caused to align with the mandrel by moving the overshot longitudinally downwardly over the mandrel.

23. The method of claim 20 wherein releasing the locking mechanism comprises applying a mechanical force, a hydraulic force, an electromechanical force, or a combination thereof to the locking mechanism.

24. The method of claim 20 further comprising re-engaging the locking mechanism after the reforming the releasable connection.

25. A downhole run-in and retrieval device comprising:

a mandrel with a first set of lugs;

an overshot with a central opening defining a wall having a second set of lugs disposed therein, the opening being adapted to receive the mandrel, wherein the first set of lugs and the second set of lugs interact to form a releasable connection; and a slidable locking mechanism, wherein the slidable locking mechanism secures the lugs' interaction in the connected position.

26. The device of claim 25 wherein the first set of lugs and the second set of lugs engage to support a weight below the releasable connection.

27. The device of claim 25 wherein the first set of lugs and the second set of lugs are connectable and releasable by less than a 360-degree relative rotation between the mandrel and the overshot.

28. A downhole run-in and retrieval device comprising:

a mandrel with a first set of lugs;

an overshot with a central opening defining a wall having a second set of lugs disposed therein, the opening being adapted to receive the mandrel, wherein the fast set of lugs interact to form a releasable connection, wherein the first set of lugs and the second set of lugs are connectable and releasable by less than a 360-degree relative rotation between the mandrel and the overshot; and wherein at least one of the second set of lugs is adapted to interact with a J-slot on the mandrel to cause the relative rotation as the overshot is moved axially downwardly over the mandrel.

* * * * *